United States Patent [19]

Trost et al.

[11] 4,105,052

[45] Aug. 8, 1978

[54] MODULAR CONSTRUCTION FOR TRIAXIAL WEAVING MACHINE

[75] Inventors: Wayne C. Trost; Burns Darsie, both of Rockford, Ill.

[73] Assignee: Barber-Colman Company, Rockford, Ill.

[21] Appl. No.: 757,773

[22] Filed: Dec. 27, 1976

Related U.S. Application Data

[63] Continuation of Ser. No. 670,177, Feb. 24, 1976.

[51] Int. Cl.[2] ..... D03D 41/00

[52] U.S. Cl. ..... 139/101; 139/DIG. 1

[58] Field of Search ..... 139/DIG. 1, 11, 12, 139/13 R, 16, 100, 101, 102, 104

[56] References Cited

U.S. PATENT DOCUMENTS

| | | | |
|---|---|---|---|
| 577,981 | 3/1897 | Gilfillan | 139/102 |
| 858,761 | 7/1907 | Ryon | 139/100 |
| 1,184,790 | 5/1916 | Trautuetter | 139/DIG. 1 |
| 2,273,325 | 2/1942 | Kinsella | 139/13 R |
| 2,383,903 | 8/1945 | Zerbee | 139/97 |
| 2,433,190 | 12/1947 | Ancet | 139/13 R |
| 2,679,264 | 5/1954 | Dunod | 139/13 R |
| 3,799,209 | 3/1974 | Dow et al. | 139/DIG. 1 |
| 3,965,939 | 6/1976 | Kulczycki et al. | 139/DIG. 1 |
| 4,015,637 | 4/1977 | Halton et al. | 139/DIG. 1 |

*Primary Examiner*—Henry S. Jaudon
*Attorney, Agent, or Firm*—A. Richard Koch

[57] ABSTRACT

A triaxial weaving machine of modular construction comprises separable warp supply and weaving modules to simplify manufacture and permit more efficient use of the machine. Modules of the same kind are interchangeable.

14 Claims, 3 Drawing Figures

MODULAR CONSTRUCTION FOR TRIAXIAL WEAVING MACHINE

This is a continuation, of application Ser. No. 670,117, filed Mar. 24, 1976.

BACKGROUND OF THE INVENTION

This invention pertains to machines for forming triaxial fabric and more particularly to machines comprising a plurality of separable modules.

Triaxial weaving machines, such as are disclosed in U.S. Pat. Nos. 3,799,209, issued to Norris F. Dow and Murray Halton on Mar. 26, 1974, and 3,884,429, issued to Norris F. Dow on May 20, 1975, were constructed as a unit. Such construction required the machine to be shut down for considerable lengths of time while the sequence of heddle shedding was being changed to produce different weaving patterns and for replacing warp beams. They were especially inconvenient for making short runs. The assembly of the machine was complicated and prolonged. It required the services of highly skilled assemblers.

SUMMARY OF THE INVENTION

This invention permits concurrent assembly of component modules, thus reducing the time required for assembly and speeding delivery of triaxial weaving machines. By separate assembly of the modules, assembly is simplified because the components are more readily accessible. The components of the warp supply module are relatively rugged and easily assembled, so that less skilled and less expensive labor may be employed for their production and assembly, thus reducing cost. The more precise components of the weaving module must be carefully handled to prevent damage thereto and their assembly is more difficult. By employing more highly skilled labor for production and assembly of the weaving module only, more efficient use of such labor may be made and costs may be reduced. Modules may be separately shipped to ease handling. Maintenance and repair is simplified by making more accessible components on the separated modules. Worn out and damaged modules may be replaced without replacing the entire machine.

By use of spare modules down time of a weaving machine may be reduced, resulting in a reduction in cost of weaving triaxial cloth. The weaving pattern may be changed in one weaving module while production continues with another weaving module in the machine. The pattern changing may be accomplished at any convenient location. Pattern changing is simplified because components are more accessible. Weaving patterns produced by a weaving machine may be changed more rapidly by substituting one pre-patterned weaving module for another. Warp beams may be mounted on a warp supply module and the yarn thereon drawn through guides, warp length compensators, warp shifting combs and the like before the warp supply module is combined for operation with a weaving module. One pre-loaded warp supply module may be substituted for another to speed changes in the fibre and color of the cloth produced. The changeover may be further accelerated by tying in the ends of the new warp strands on the warp supply module with the tail ends of the old warp strands in the weaving module. Production of short runs is more easily and quickly accomplished by combining any preloaded warp supply module with any compatible pre-patterned weaving module.

DESCRIPTION OF A PREFERRED EMBODIMENT

The embodiment shown and described herein is illustrative only. It will be recognized by those skilled in the art that many substitutions and modifications may be made without departing from the teachings of this invention.

Figure 1:
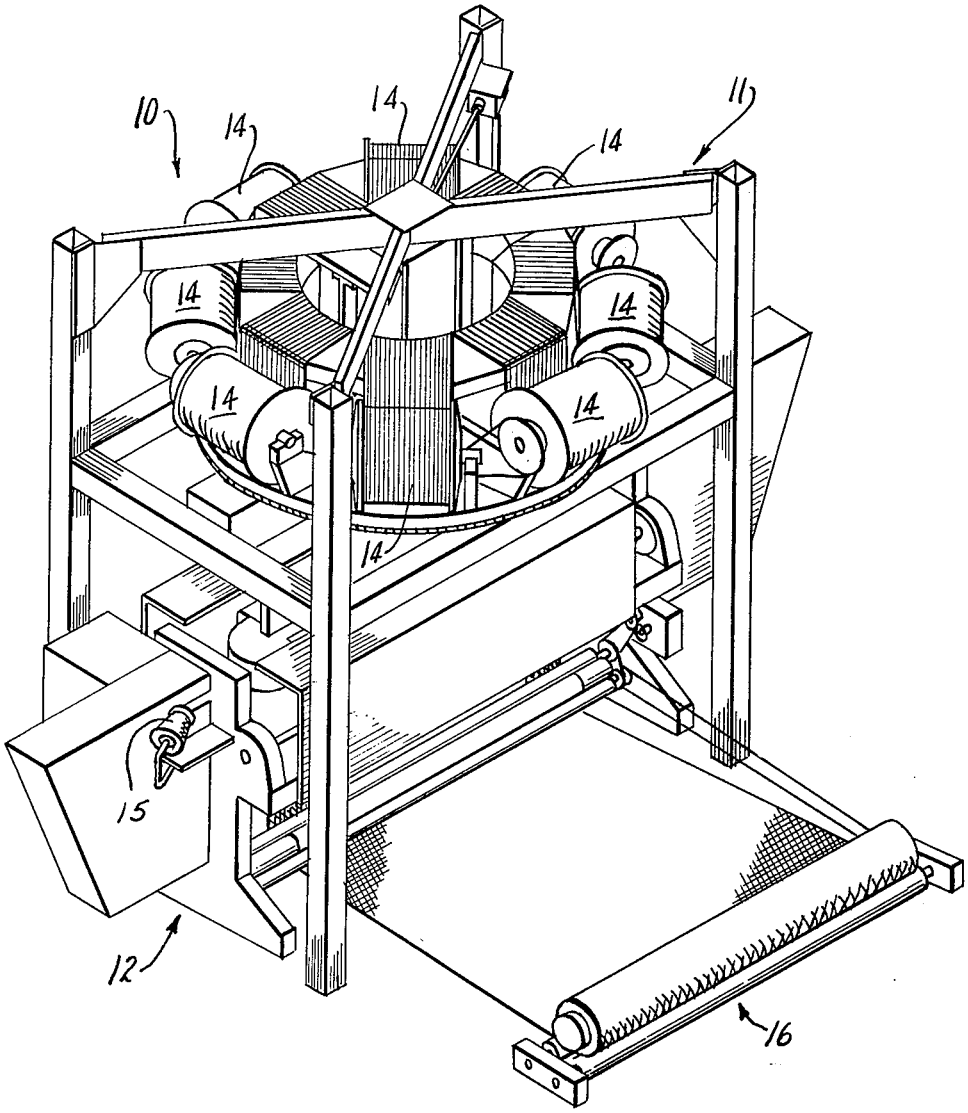
FIG. 1 is an isometric view of a triaxial weaving machine in accordance with this invention.

As seen in FIG. 1 a modular triaxial weaving machine 10 comprises a warp supply module 11 and a weaving module 12. Also shown is its relation to a separate cloth winding apparatus 16. The machine is shown as it would be when in operation with warp beams 14 mounted on the warp supply module, a weft supply 15 as a conical package on the weaving module, and a cloth winding apparatus 16.

Figure 2:
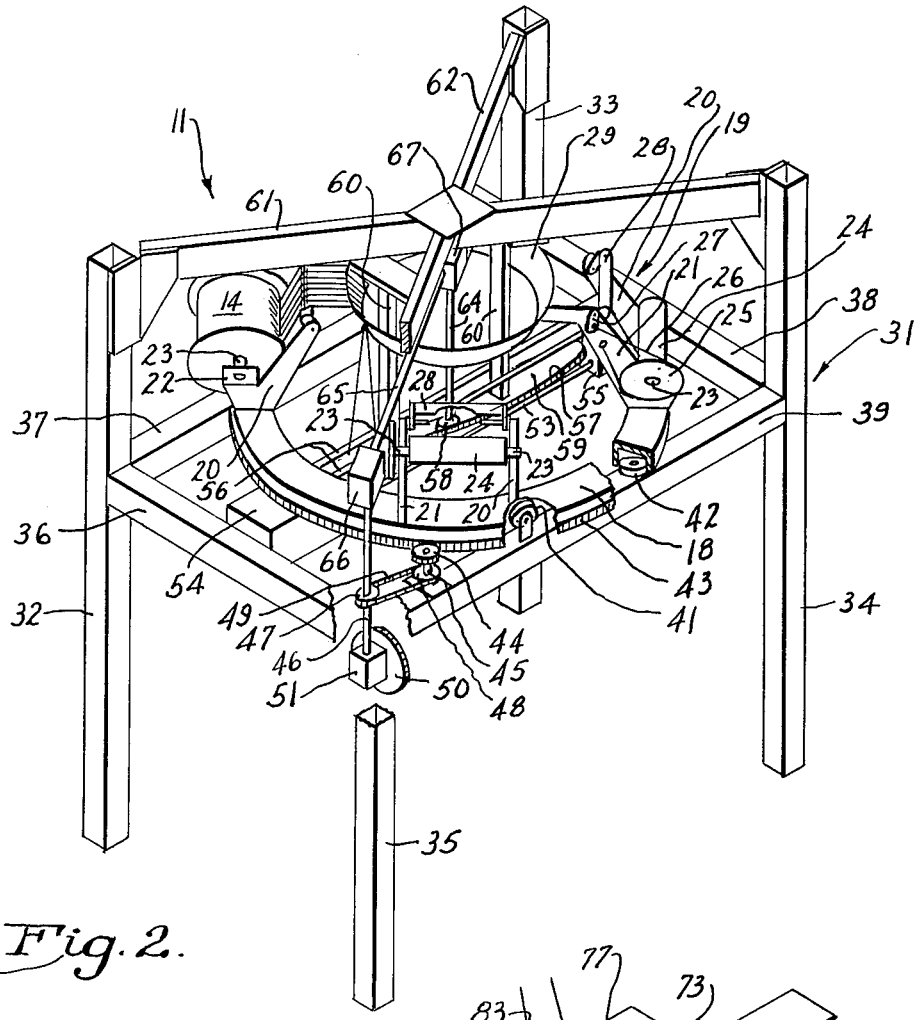
FIG. 2 is an isometric view of the warp supply module taken from the rear of the weaving machine as shown in FIG. 1. Some portions are broken away and some warp beam mountings are omitted for clarity. One warp beam is shown in position to clarify the description.

The warp supply module 11, as illustrated in FIG. 2, comprises a circular base 18 upon which, at regularly spaced stations 19 are mounted the warp beams 14. The stations comprise end brackets 20, 21, each of which has a bearing 22 receiving a rotatable shaft 23, having an enlarged key-slotted diameter 24 to be received and driven by a beam 14 when the machine is in operation. On an outboard end of shaft 23 adjacent bracket 21 is fixed a brake drum 25. A strap 26 frictionally engages the brake drum, one end of said strap being fixed on the bracket 21 and the other being attached to a brake energizing arm 27 responsive to oscillation of a whip roll 28 mounted parallel to shaft 23 and between brackets 20, 21, to control let-off. An annular warp guide 29, having a generally conical configuration is rigidly mounted concentric with and in spaced parallel relation to base 18, as on the ends of brackets 21. The components so far described comprise a rotatable creel, which may be built as a sub-assembly.

The creel is supported for rotation on a frame 31. The frame comprises legs 32, 33, 34, 35 spaced apart sufficiently to straddle weaving module 12 and connected together at a lower level by supporting beams 36, 37, 38, 39 forming a rectangle. Spaced rollers 41, with horizontal axes radial with respect to base 18, are mounted on the beams 37, 39 to support the base 18. Another set of spaced rollers 42 with vertical axes are mounted on beams 37, 39 to locate the base on the frame. As shown the base has an inverted channel cross-section with the bottom of the channel resting on rollers 41 and a side of the channel engaging rollers 42. The outer periphery of base 18 is provided with teeth 43 engaged by driving gear 44 mounted for rotation on a shelf 45 affixed to beam 39. The gear 44 is driven from a drive shaft 46 through sprockets 47, 48 and a chain 49. The drive shaft receives power from the weaving module 12 through sprocket 50 and a gear box 51 fastened to leg 35. By this mechanism the creel may be rotated in synchronism with the operation of the weaving module.

A pair of parallel reference rollers 53 in a horizontal plane are pivotally supported at their ends in brackets 54, 55 affixed to beams 36, 38. Their function is to form flat warp sheets for use in the weaving module. A pair of guide rollers 56 spaced above the reference rollers are similarly mounted. Intermediate the reference rollers 53 and guide rollers 56 is a comb 57 movable laterally by a sprocket 58 along a fixed closed horizontal path having a long axis in a vertical plane through a diameter of the base 18. The path is defined by a track 59 rigidly suspended by supports 60 from cross members 61, 62 joining legs 32, 34 and 33, 35 respectively at an upper level. The sprocket 58 is fixed to the end of a vertical shaft 64, driven from drive shaft 46 through a horizontal jack shaft 65 and gear boxes 66, 67 fastened to cross member 62. By this mechanism the movements of the creel and comb are synchronized. It will be seen that warp strands engaged by comb 57 on one side of the longitudinal axis of the path will be moving in one direction, while those on the other side will be moving in opposite direction to form two oppositely moving warp sheets. A warp strand changing direction at an end of the axis is obtained from a beam 14 aligned with the aforesaid axis and the speeds of the comb 57 and base 18 are such that each makes a complete circuit in the same time. As the base and comb move, the length of a warp strand passing from a beam 14 to the comb 57 varies with its instantaneous location. By proper choice of path, compensation for these changes in warp length may be provided, as disclosed in a patent application Ser. No. 653,490 filed Jan. 29, 1976 by Burns Darsie and Richard A. Schewe. Another warp length compensation is disclosed in a patent application Ser. No. 63,371, filed Jan. 29, 1976 by Franklin L. Townsend and Robert L. Govig. When the latter warp length compensation is employed, the path of comb 57 is substantially a straight line on each side of the longitudinal axis of the path. The reference rollers 53 can be omitted when the latter compensation is employed because the warp sheets are already flat. The guide rollers 54 can be omitted since they are used only in connection with the former warp compensation. The brackets 54, 55 then become useless and may be omitted.

Figure 3:
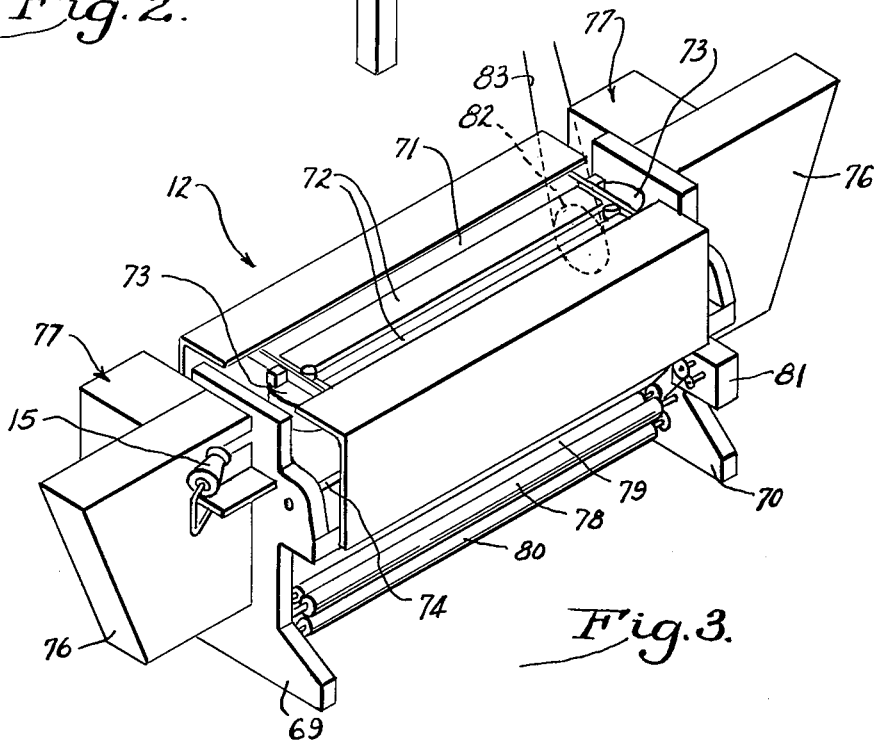
FIG. 3 is an isometric view of the weaving module shown in FIG. 1.

The weaving module 12, as shown in FIG. 3, is supported by a pair of end plates 69, 70. Between the end plates are a warp shedding mechanism 71, mechanisms 72 for shifting heddles weftwise, mechanisms 73 for transferring heddles from the end of one row being shifted toward the transfer mechanism to the end of another row being shifted away from said transfer mechanism, and drive shafts 74 supplying power to the mechanisms. There are two interconnected drive shafts symmetrically located front and rear, but only one is visible. In like manner only half of the heddle shedding mechanism 71 is visible. Rapier drives 76 of the weft inserting mechanisms 77 are mounted outboard on the end plates 69, 70. The weft inserting mechanisms receive power from the rear drive shaft (not shown). Take-up is provided by a pinch roll 78 in cooperation with powered take-up rolls 79, 80, pivotally mounted between the end plates 69, 70 and driven from front drive shaft 74 through a gear reducer and ratchet mechanism 81. A sprocket 82, shown in dashed lines, is affixed to the rear drive shaft and is connectable by a chain 83 to the sprocket 50 on the warp supply module 11. By use of positive chain and sprocket or gear drives, it will be seen that the operations of the separable modules are completely synchronized. The lateral movement of a warp strand by the comb 57 in warp supply module 11 is always in the same direction as its movement by a heddle shifted by mechanism 72 and transferred by mechanism 73 in weaving module 12.

A heddle shifting mechanism suitable for use in this invention is disclosed and claimed in a copending patent application, Ser. No. 603,657, filed Aug. 11, 1975 by Karol Kulczycki. Suitable heddle transfer mechanisms are disclosed and claimed in copending patent applications Ser. No. 603,756, filed Aug. 11, 1975 by Karol Kulczycki and Burns Darsie, and Ser. No. 620,332, filed Oct. 7, 1975 by Franklin L. Townsend and Frank P. Trumpio.

The co-pending patent applications mentioned herein are owned in common with the present invention and incorporated by reference into this specification to the extent necessary for a full and complete understanding of the present invention.

I claim:

1. A separable modular triaxial weaving machine comprising in selective combination a warp supply module having means for forming a plurality of warp strands into a pair of flat warp sheets moving laterally in opposite directions, and a weaving module having means for forming said oppositely moving warp sheets into sheds, said warp supply and weaving modules being individual independently mounted units, said warp supply module comprising a frame having a plurality of upright legs which straddle the weaving module and are spaced so as to provide an opening which permits movement of the weaving module therebetween, said frame mounting the warp supply above the weaving module, drive means for the weaving module, driven means for the warp supply module, and positive interconnecting means connecting the drive means with the drive means so as to insure synchronism of the operation of the modules.

2. A weaving machine according to claim 1 further comprising a rotatable creel in said warp supply module, heddle shifting means in the weaving module, and means for synchronizing the rotation of said creel and the movement of said heddle shifting means.

3. A weaving machine according to claim 1 further comprising a comb movable in a fixed path in said warp supply module, heddle shifting means in said weaving module, and means for synchronizing the movements of said comb and said heddle shifting means.

4. A weaving machine according to claim 1, said weaving module additionally comprising weft inserting means.

5. A weaving machine according to claim 1, said weaving module further comprising means for moving said warp sheets weftwise.

6. A weaving machine according to claim 1, said weaving module further comprising heddle shifting means.

7. A weaving according to claim 1, said weaving module additionally comprising heddle transfer means.

8. A weaving machine according to claim 1, said weaving module further comprising weft inserting means, heddle shifting means, heddle transfer means, and means for synchronizing operation of said warp shedding, weft inserting, heddle shifting and heddle transfer means.

9. A weaving machine according to claim 1, said warp supply module further comprising a rotatable creel for moving said warp strands in a substantially annular path.

10. A weaving machine according to claim 9 said warp supply module further comprising means for rotating the creel.

11. A weaving machine according to claim 9 wherein said means for moving said warp strands laterally in opposite directions comprises a comb to engage the warp strands, and means for moving said comb in a fixed path.

12. A weaving machine according to claim 11 said warp supply module further comprising means for synchronizing the movement of said comb with the rotation of said creel.

13. A weaving machine according to claim 11 wherein said fixed path comprises a straight line.

14. A weaving machine according to claim 11 wherein the warp strands moved laterally by said comb pass to said means for forming flat warp sheets.

* * * * *

UNITED STATES PATENT OFFICE

CERTIFICATE OF CORRECTION

Patent No. 4,105,052 Dated August 8, 1978

Inventor(s) Wayne C. Trost and Burns Darsie

It is certified that error appears in the above-identified patent and that said Letters Patent are hereby corrected as shown below:

Column 4, line 36, change "drive" to --driven--.

Signed and Sealed this

*Sixth* Day of *February 1979*

[SEAL]

*Attest:*

RUTH C. MASON
*Attesting Officer*

DONALD W. BANNER
*Commissioner of Patents and Trademarks*